United States Patent [19]

Gratzmuller

[11] 4,243,855

[45] Jan. 6, 1981

[54] HYDRAULIC SYSTEM FOR SIMULTANEOUS CONTROL, ESPECIALLY FOR THE CONTROL OF ELECTRIC CIRCUIT BREAKERS

[76] Inventor: Claude A. Gratzmuller, 97 avenue Victor Hugo, 75016 Paris, France

[21] Appl. No.: 960,742

[22] Filed: Nov. 15, 1978

[30] Foreign Application Priority Data

Dec. 2, 1977 [FR] France ..... 77 36277

[51] Int. Cl.[3] ..... H01H 35/24; F15B 11/16

[52] U.S. Cl. ..... 200/81.4; 91/189 R; 91/433; 91/451; 91/517; 200/81 R; 200/81.5; 200/145; 91/471

[58] Field of Search ..... 91/171, 189 R, 471, 91/517, 518, 523, 451, 452, 433; 200/145, 81 R, 81.4, 81.5, 82 R, 82 B

[56] References Cited

U.S. PATENT DOCUMENTS

| | | | |
|---|---|---|---|
| 2,365,095 | 12/1944 | Miller | 91/171 |
| 3,030,930 | 4/1962 | Gratzmuller | 91/451 |
| 3,480,328 | 11/1969 | Carlson | 91/171 |
| 3,659,498 | 5/1972 | Richardson | 91/171 |
| 4,101,746 | 7/1978 | Grieger | 200/81.5 |

FOREIGN PATENT DOCUMENTS

| | | |
|---|---|---|
| 1098565 | 1/1954 | France . |
| 67250 | 12/1954 | France . |
| 1355701 | 2/1963 | France . |

*Primary Examiner*—Abraham Hershkovitz
*Attorney, Agent, or Firm*—Holman & Stern

[57] ABSTRACT

Two circuit breakers or circuit breaker modules are actuated by hydraulic jacks fed by supply and drain valves operated by a single closing-operation control unit. A differential pressure detector is subjected to the pressure of the two jacks. In the event of a relative variation in the jack-operating times, the free piston of the detector actuates a switching device which connects the supply and drain valves to the drain tank, thus preventing the complete performance of any non-simultaneous operation of the circuit breakers.

13 Claims, 5 Drawing Figures

22"
70
68
66
66
90
90'
98
96
92
92
36
48
48'
50
50'
$40_2$
$40_3$
$28_1$
$28_2$
94
94
46
38
38'
43
43'
12
12'
16
16'
76
76'
64
64'
84
86
86'
88
88'
72
72'
82
74
74'
80
80'
78
78'
32
32'
59
59'
57
57'
61
61'
62
62'
18
18'
30
30'
28
28'
24
24'
22
22'

HYDRAULIC SYSTEM FOR SIMULTANEOUS CONTROL, ESPECIALLY FOR THE CONTROL OF ELECTRIC CIRCUIT BREAKERS

This invention relates to a hydraulic control system in which the simultaneous operation of at least two motors driven by fluid under pressure is intended to be controlled from a first position such as a non-operating or rest position to a second position such as an operating or work position. The invention is more especially directed to a method and an installation for controlling the operation of at least two hydraulic jacks in a reliably simultaneous manner, each jack being intended to actuate a circuit breaker module from an open or tripped position to a closed position.

As a result of present trends towards higher transmission voltages in electric power distribution systems, it is no longer sufficient to provide each phase with a single circuit breaker (having a single or multiple break chamber) in order to carry out switching functions. It has now proved necessary for this purpose to make provision for a number of unitary circuit breakers (two or three, for example) on each phase to be interrupted. A unitary circuit breaker of this type comprising a single or multiple break chamber is commonly designated as a "circuit breaker module". Each module is actuated by an individual jack and all the jacks are controlled by means of a single pressurization order.

It is wholly evident that all these "modules" mounted in series on the same phase must operate with perfect simultaneity, especially for the circuit-breaker closing operation. The reason for this condition will be apparent if it is assumed by way of example that, during a closing operation, one of the modules has not yet closed whereas the other module (or the other two modules) has already reached the closed position. In this case the module which has not yet closed would be subjected to a voltage having twice (or three times) the value for which it was designed, with the result that this module would be either damaged or destroyed.

In addition, it is clearly important to ensure that module opening operations also take place with perfect simultaneity. However, the difficulties in this case are relatively minor since the tripping action (which is a safety operation and usually consists in draining-off all the fluid circuits) takes place in a much shorter time (a few milliseconds) and is more reliable than the closing action; this latter consists in restoring the pressure in the fluid circuits and thus constitutes only a resetting operation. Furthermore, during the closing operation, all the modules undergo displacement to the rest position, namely to the isolating position.

The aim of the invention is to eliminate hazards arising from so-called "discordances" or more specifically from lack of simultaneity in the operation of the circuit-breaker modules, and especially the closing operation. This result is obtained by automatically preventing complete execution of the single closing order in the event of a discordance taking place between the effective operating times of the individual modules.

The method in accordance with the invention consists in comparing the pressures within the jacks of the modules in response to the single pressurization order, in detecting any pressure difference within the jacks resulting from a discordance, in producing in response to said pressure difference an order for return to the rest position, and in applying this order to all the jacks, thereby preventing any complete non-simultaneous operation from the rest position to the work position. In the event of discordance, the result thus achieved is that one or a number of modules can undergo a partial displacement followed by a return to the rest position. This partial displacement is unobjectionable since the break distances between contacts are considerably greater than the distance which is necessary to ensure isolation between the contacts.

In the event that the invention is applied to circuit breaker modules having a tripping action which is carried out in accordance with usual practice by continuously available resillient or elastic means (e.g. pneumatic or metallic tripping springs), the above-mentioned order for return to the rest position is simply an order for draining-off all the jacks, with the result that said jacks all return to the rest position under the action of the elastic tripping means.

In many known types of circuit-breaker control systems, the closed position of the breaker is maintained in opposition to permanent resilient tripping means, after disappearance of the transient trip order, by means of a self-maintaining fluid circuit. In this case, and in accordance with the new and novel method of the invention, the above-mentioned draining-off order produced by the appearance of a discordance is applied to the self-maintaining circuits of the different modules.

An installation in accordance with the invention comprises at least one differential pressure detector which connects the module jacks together in pairs. The installation further comprises a rest control device which is operated in dependence on each detector and comes into action in response to a pressure difference. Each rest control device is connected to all the jack control valve systems in order to bring said valves to the position corresponding to return of the jacks to the non-operating or rest position. By virtue of this arrangement, it is only necessary for at least one of the detectors to detect a pressure difference and therefore a discordance in order to return the jacks of all the modules to the rest position.

In installations for the distribution of polyphase and especially three-phase alternating-current, each circuit breaker (either single or consisting of a plurality of "modules") which is mounted on each phase can usually be controlled individually. The advantage offered by this possibility lies in the fact that, in the event of a fault condition on a single phase, only the phase concerned need be interrupted. If the fault is only transient and disappears as a result of the interruption, a general interruption on all three phases is thus prevented.

In some installations on the contrary, the three circuit breakers (either single or consisting of a number of "modules") mounted on the three phases are controlled together from a single order. In other words, if a fault occurs on one phase, a single trip order is delivered in order to interrupt the three phases. In this case also, it is very important from a safety standpoint to ensure that the single trip order is actually carried out by the three circuit breakers of the three phases without any discordance. There would in fact be a potential danger of serious consequences if the circuit-breaker for protecting the phase in which a fault has occurred were to remain closed as a result of either failure or delayed action.

For the reason just given, it is preferable to make provision in installations of this type for a safety system which detects any tripping "discordance" between the three phases and, in the event of detection of such a discordance, produces a direct trip order which is applied directly to all the circuit breakers.

By virtue of its differential pressure detector, the device in accordance with the invention also makes it possible to perform the safety function mentioned above. In the remainder of the present description, the term "circuit breaker modules" will therefore apply both to unitary breakers, a number of which are interposed in series on a single phase, and to a plurality of breakers interposed on all the phases of a power supply system.

A more complete understanding of the invention will be gained from the following detailed description and from the accompanying drawings in which a number of embodiments of the invention are illustrated by way of example without any limitation being implied, and in which.

Figure 1:
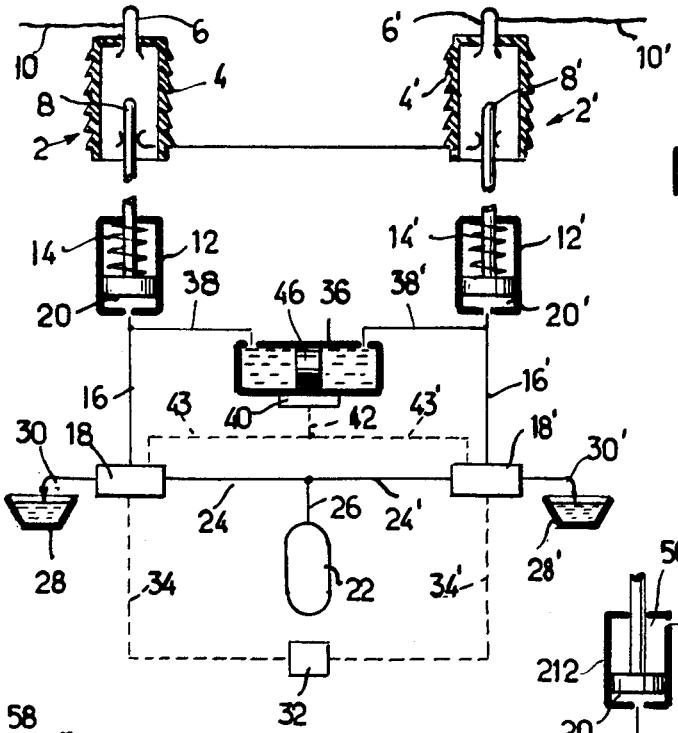
FIG. 1 is a schematic view of an installation in accordance with the invention for the simultaneous control of two spring-trip circuit breaker modules.

The circuit breaker and its hydraulic control system shown in FIG. 1 is made up of two modules 2 and 2' each comprising a break chamber 4–4' which contains a stationary contact 6–6' and a moving contact 8–8'. The two modules are mounted in series on the high-tension electric power line 10 to be interrupted.

It will be readily understood that each module could be of the type comprising a multiple break chamber.

Each moving contact 8–8' is actuated in the direction of the work position (closing position) by a single-acting hydraulic jack 12–12' but is urged towards the rest position by a tripping spring 14–14'.

Each jack is connected by means of a pipe 16–16' to a servo-controlled valve 18–18' having two positions. In its first position, the valve 18 (or 18') connects the active chamber 20 (or 20') of the corresponding jack to a source of fluid under pressure such as a hydropneumatic accumulator 22 by means of pipes 24–24' (26) in order to bring the jacks into the work position and consequently in order to bring the moving contacts 8–8' to the closed position.

In its second position, the valve 18 or 18' causes the corresponding jack to return to its rest position. In the case illustrated in FIG. 1 in which the jacks are continuously urged to the rest position by the tripping spring 14–14', the second position of the valve 18–18' establishes a communication between the chamber 20–20' of the corresponding jack and a sump or collector-tank 28–28' by means of the pipes 16–30 and 16' (30').

The two valves 18–18' are servo-controlled from a single-acting control unit 32 in accordance with customary practice. In the majority of instances, the control unit has transient action at least for switching the valves 18–18' from the second positions to the first positions of these latter (closing-action control). Electric or hydraulic control lines 34–34' connect the control unit 32 to the valves 18–18'. In practice, the valves for hydraulic breaker-control operations are constituted by valve systems with hydraulic relays, transient-action closing and tripping electro-valves, hydraulic self-maintaining circuit and so forth which do not form part of the invention and are much more complex than the simplified diagrams of FIGS. 1, 3 and 4, these diagrams being given only to illustrate the invention.

It already becomes apparent from the starting positions shown in FIG. 1 that, if the breaker-closing control device 32 is actuated, the two valves 18–18' come into the first position (supply position) and the two chambers of the jack 20–20' are supplied simultaneously. But if a discordance takes place in the switching of the two valves or in the speed of travel of the jack pistons, for example by reason of the length of hydraulic connections between modules, one of the moving contacts is liable to reach the closed position before the other contact, with the result that the full voltage of the phase considered is applied to the module which has not yet closed.

In accordance with the invention, the installation comprises a differential pressure detector 36 for connecting the two jacks 12–12' to each other by means of pipe lines 38–38'. A rest control device 40 is operated in dependence on the detector 36 and comes into action if a differential pressure between the two jacks appears within the detector 36 as a result of a discordance in the operation of the two jacks.

The rest control device 40 is connected by means of electric or hydraulic control lines 42–43–43' to the two valves (in practice to the valve systems equivalent to the valves 18–18') in order to return all the valves to the draining-off or discharge position (second position) if the detector measures a pressure difference. It can thus be seen that any discordance between the operation of the two jacks resulting in a pressure difference between the two jacks is detected and converted to a priority tripping signal which cancels the closing signal. In consequence, any breaker-closing operation which may exhibit a discordance between modules is interrupted before one of the moving contacts has reached the closed position, thereby removing any potential danger of application of a hazardous overvoltage to any one of the modules in the event of discordance.

Figure 2:
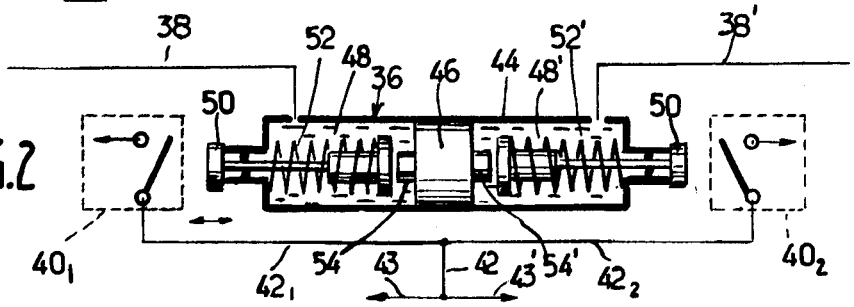
FIG. 2 is a sectional view of one embodiment of the differential pressure detector and of the rest control device which is operated in dependence on said detector.

There is shown diagrammatically in FIG. 2 one embodiment of a differential pressure detector together with its associated rest control device. The detector 36 is constituted by a cylinder 44 and a free piston 46 which is slidably mounted within said cylinder and divides this latter into two chambers 48–48'. Each chamber communicates with the corresponding jack by means of the pipe lines 38–38'. An emergent sliding rod (50–50') passes through both ends of the cylinder 44 and is restored to the withdrawn position by a spring 52–52'.

In the event of a pressure difference between the two chambers 48–48', the free piston 46 undergoes a displacement towards either end of the cylinder 44 and one of the extensions 54 or 54' carried by the piston is applied against the extremity of one of the rods 50 in order to cause this latter to project from the cylinder. The associated rest control device 50 can be constituted by a first electric switch $40_1$ and by a second electric switch $40_2$ which are mounted in parallel. By closing either of the two switches, the electric circuit $42_1$–$42_2$–42–43–43' is established and initiates the return of the valves 18–18' to the second position (draining-off or discharge position). There will be described below in connection with FIG. 5 another embodiment in which the rest control device 40 is no longer electrical but is of the hydraulic control type.

Figure 3:
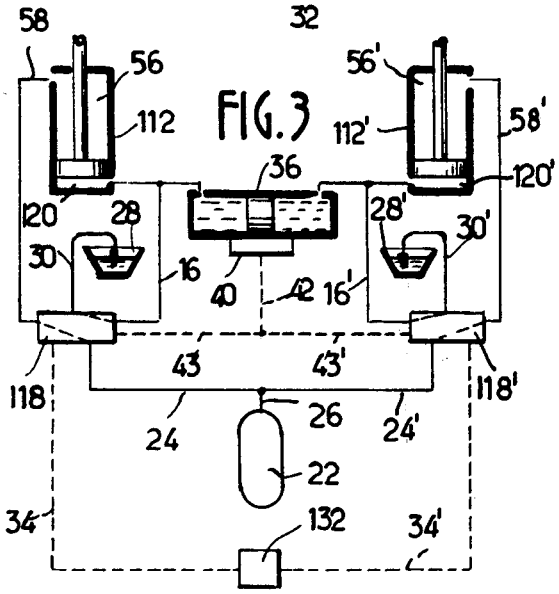
FIG. 3 illustrates the method in the case of control of modules actuated by double-acting hydraulic jacks.

There is shown in FIG. 3 an installation which is similar to that of FIG. 1 for two circuit breaker modules but in which each module is actuated by a double-acting jack 112–112' under the control of a two-position valve 118–118'. A control system of this type is conventional and it is sufficient to mention that, in the first position of the valve 118 (closed or lock-in position), the chamber 120 of the jack is put into communication with the hydropneumatic accumulator 22 via the pipe lines 16–2-4–26 whilst the upper chamber 56 is connected to the drain tank via the pipe lines 58 and 30. When the valve 118 is switched to its second position (tripped position) by means of the control device 132, the configuration is reversed. In other words, the chamber 56 is put into communication with the accumulator and the chamber 120 is connected to the drain tank. The arrangement of the differential pressure detector 36 is identical with the arrangement described in connection with FIGS. 1 and 2. The rest control device 40 which operates in dependence on the detector transmits to the two valves 118–118' via the electric or hydraulic control lines 42–4-3–43' an order for return to the second position (tripped position) in the event of appearance of a discordance in the operation of the modules.

The invention also applies to hydraulic circuit-breaker control systems of another known type in which the hydraulic control jack is of the double-acting differential type in which the upper chamber 56 (shown in FIG. 4) is continuously connected to the source of fluid under pressure, that is to say to the accumulator via pipe lines 60. The continuous elastic action towards the tripped position is always available for the tripping operation and is thus a pneumatic elastic action (namely the action produced by the gas cushion of the accumulator) which is transmitted by means of a hydraulic connection in accordance with well-known practice. In this case as in the case of FIG. 1, tripping is carried out simply by connecting the active chambers 20 of the jacks to the drain tank.

Figure 4:
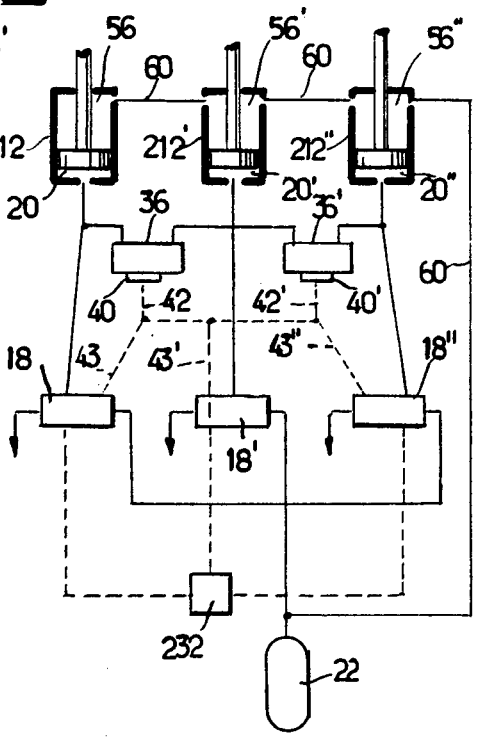
FIG. 4 is a schematic view of an installation in accordance with the invention for the control of three circuit breaker modules tripped by permanent hydropneumatic elastic means.

FIG. 4 shows an installation comprising three modules each controlled by a jack 212–212'–212''. The installation therefore comprises three valves (or valve systems) 18–18'–18'' which are operated by a single control device 232. In accordance with the invention, a differential pressure detector 36–36' such as a free-piston detector, for example, is interposed between each pair of jacks, each detector being intended to actuate a rest control device 40–40' (drain-off control).

FIG. 4 shows that it is only necessary to provide two differential pressure detectors 36–36' in the case of a three-module installation and that, in more general terms, provision need be made for only N-1 detectors in the case of an installation comprising N modules.

In fact, the drain-off device 40 of the first detector initiates the return of the three valves 18–18'–18'' to the drain-off position via the electric or hydraulic connections 42–43–43'–43'' and the same applies to the second detector by virtue of the connections 42'–43–43'–43''.

It is therefore apparent that any differential pressure which appears between any two jacks and therefore any discordance which appears in the operation of any two modules will initiate the appearance of a draining-off signal which will be applied to all the valves, thereby removing any attendant danger of discordant closing action.

Figure 5:
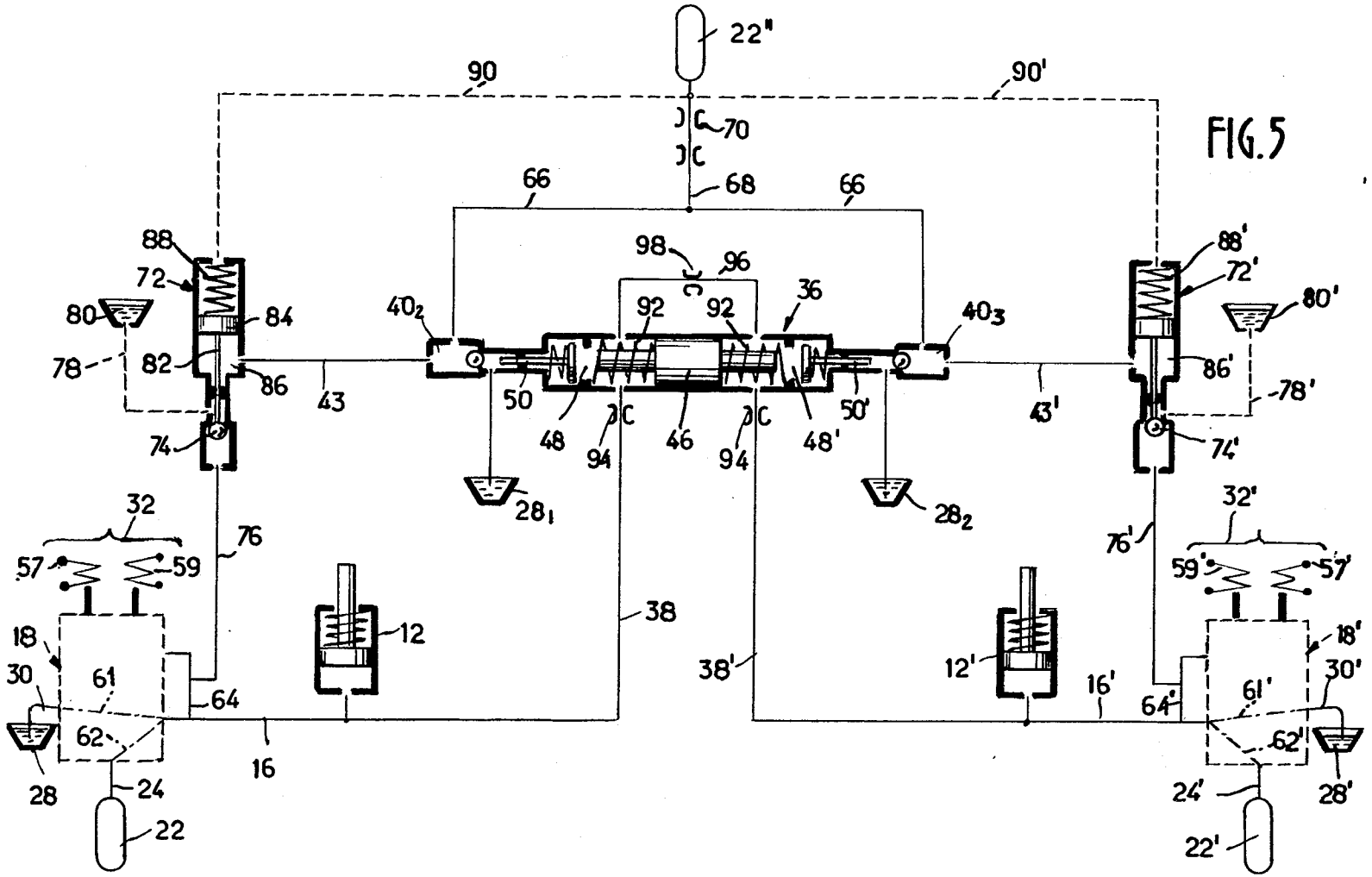
FIG. 5 is a schematic view of an installation which is similar to FIG. 1 but in which the discordance signal produced by the detector is a hydraulic signal for returning the associated modules to the rest position.

The installation shown in FIG. 5 is a preferred embodiment which is similar to that shown in FIGS. 1 and 2 but in which the rest control device associated with the differential pressure detector generates a hydraulic signal (and no longer an electrical signal) for returning the breaker-actuating hydraulic jacks or the breaker modules to the rest position.

The elements of FIG. 5 which are identical with those of FIGS. 1 and 2 are designated by the same reference numerals and have the same functions. No further reference will therefore be made to these elements in the following description.

As mentioned earlier, the two supply and drain valves 18–18' of the jacks 12–12' are preferably of the hydraulic relay type and actuated by a control device 32–32' in the case of normal operations. Each valve 18–18' comprises a tripping electrovalve 57–57' and a tripping electrovalve 59–59'.

The valves 18–18' employed in the installation of FIG. 5 are hydraulic self-maintaining valves, especially of the type described in French Pat. No. 1,098,565 and in the French patent of Addition No. 67 250 filed respectively on Jan. 15th, 1954 and Dec. 28th, 1954, or of the type described in French Pat. No. 1,355,701 filed on Feb. 6th, 1963, all these patents having been filed in the name of Jean-Louis Gratzmuller.

It is therefore unnecessary to describe these hydraulic self-maintaining systems (or so-called "hydraulic guard" systems). It can simply be recalled that, when the valves 18–18' are located in the drain-off position (namely the connection indicated by the lines 61–61'), only transient excitation of the tripping electrovalves 57–57' is necessary to bring the valves 18–18' to the position of supply of the jacks 12–12' (this connection being indicated by the lines 62–62'). After disappearance of the transient tripping signal, this position is maintained by putting under pressure and pressure-maintenance of the hydraulic guard circuit 64–64'.

For the sake of enhanced clarity, the drawings only give outline illustrations of the valves 18–18', the hydraulic guard circuits 64–64', the connections 24 and 30 respectively with the oleopneumatic accumulator 22 and the collector-tank 28, as well as the electrovalves 57–59.

With this type of self-maintaining valve, it is only necessary in order to initiate a trip (return of the valve to the drain-off position indicated by the connection 61) to produce transient excitation of the tripping electrovalve 59 which connects the corresponding hydraulic guard circuit 64 to the drain tank.

Finally, it is readily apparent that, in the case of normal operations, the electrovalves 57–57' are both energized together by the single control device designated in FIG. 1 by the reference 32 and that the same applies in the case of the electrovalves 59–59', in order to obtain simultaneous operations of the two (or more than two) circuit breaker modules.

In the event of discordance in the operations of the jacks 12–12', the differential pressure detector 36 produces a hydraulic pressure signal which has the effect of draining-off all the hydraulic self-maintaining circuits 64–64' of the valves 18–18'.

In this embodiment, each sliding rod 50–50' (also shown in FIG. 2) of the detector 36 produces action on the closure member of a drain valve $40_2$–$40_3$, a communication being established between the bodies of these two drain valves by means of a connecting-pipe line 66. As can readily be understood, it is therefore only necessary to ensure that the free piston 46 of the detector 36 is thrust either to the right or to the left under the action of a pressure difference in order to discharge to the collector-tanks $28_1$–$28_2$ both the connecting-pipe lines 43–43' which are normally maintained under pressure by means of a line 68 providing a connection with a hydraulic pressure supply 22''. One or a number of calibrated constrictions or throats 70 are provided in the connecting line 68 in order to ensure that the flow rate of fluid derived from the accumulator 22'' is much lower than the drain-off flow rate of the valves $40_2$–$40_3$.

The discordance signal is therefore constituted by a pressure drop signal within the lines 43–43'. This signal is transmitted to the hydraulic guard circuits 64–64' by means of a pressure-regulating drain-off unit 72–72'.

Each pressure-regulating drain-off unit 72 can be provided with a closure member 74 for normally preventing communication between a pipe line 76 which is connected to the hydraulic guard circuit 64 and a pipe line 78 which opens into a low-pressure collector-tank 80. The closure member 74 can be actuated in the direction of opening by means of a rod 82 carried by a piston 84, said piston being slidably mounted within a chamber 86 which is subjected to the pressure of the pipe line 43 and being urged in opposition to said pressure by a calibrated spring 88. It is of course the customary practice to ensure that, both within the drain-off units 72–72' and within the valves $40_2$–$40_3$, the closure members which usually consist of balls are normally held against their seats by light springs which have not been shown in the drawings.

In the position illustrated in FIG. 5 and assuming that there is no pressure difference on each side of the piston 46 of the detector 36, the pipe lines 43–43' are at the pressure of the accumulator 22''. This pressure is maintained within the chambers 86–86' of the drain-off units 72–72' and thrusts back the pistons 84–84' in opposition to the springs 88–88'. The closure members or valve balls 74–74' are therefore closed and the hydraulic guard circuits 64–64' are not put into communication with the collector-tank via the pipe lines 76–76'.

Should a discordance occur during operation of the jacks 12–12', the two pipe lines 43–43' are connected to the drain tank as has already been noted earlier and the pressure drops within the chambers 86–86' of the pressure-regulating drain-off units 72–72', the closure balls of which open under the action of the springs 88–88'. All the hydraulic guard circuits 64–64' are therefore connected to the drain tank and all the jacks 12–12' accordingly return to the rest position. In other words, the complete performance of a non-simultaneous operation is prevented.

It is worthy of note that transmission of the hydraulic discordance-signal to the guard circuits by means of the pressure-regulating drain-off units 72–72' offers the following advantage: it is only a pressure drop within the pipe lines 43–43' which initiates the opening of the drain-off units 72–72' and these pipe lines do not need to be entirely drained to atmospheric pressure. The response time of the safety system in accordance with the invention is thus considerably reduced.

As described in the foregoing, spring-loaded drain valves can serve to constitute the pressure-regulating drain-off units but it would also be possible to replace the action of the springs 88–88' by an oppositely-acting hydraulic pressure on the other face of the pistons 84–84'. By way of example, this pressure is supplied from the accumulator 22'' via pipe lines 90–90' as shown in dashed lines.

In order to illustrate the hydraulic system with greater clarity, FIG. 5 shows a number of oleopneumatic accumulators 22, 22', 22'' and a numberof low-pressure collector-tanks 28–$28_1$–80 and so forth. As can readily be understood, however, it would be possible in practice to employ a general accumulator and a general collector-tank.

In a safety installation in accordance with the invention, it is important to ensure that the discordance detector does not have excessive sensitivity which would cause returns to the rest position even in respect of low and non-hazardous pressure differences. Excessive sensitivity would also be liable to produce "hunting" or pulsatory phenomena which would be harmful to the installation. Steps are therefore taken to limit the detection sensitivity.

One of these steps (which is also illustrated in FIG. 2) consists in providing a dead range of travel in the displacements of the free piston 46 of the detector 36. In order words, there exists a gap between the extensions 54–54' of the piston and the extremities of the rods 50 in the normal central position of the piston 46.

Another step consists (as shown in FIG. 5) in providing centering springs 92 for the free piston 46. These springs not only restore the piston to the central position when there is no pressure difference but the force of said springs acts in opposition to the displacements of the piston under the action of small pressure differences. In the pipe lines 38–38' which provide a connection between the jacks 12–12' and the opposite chambers 48–48' of the detector 36, provision can also be made for constrictions 94 which are suitably calibrated for damping pressure variations between the chambers 48–48'.

Finally, it is also an advantage to establish a direct connection 96 between the two chambers 48–48'. A constriction 98 is again formed in this connecting line in order to produce a predetermined delay in the displacements of the piston 46 and in order to re-establish equality of pressures and to permit the return of the piston to the central position. It is readily apparent that, in a practical construction, a direct connection of this type could be made, not outside the detector 36, but by means of a bore which is drilled in the detector body.

I claim:

1. A fluid control installation for simultaneously bringing at least two motors driven by fluid under pressure from a rest position to a work position, especially at least two hydraulic jacks so arranged that each jack actuates a circuit breaker module for bringing said modules either to the closed position or to the open position and for preventing any non-simultaneous operation of said motors, said installation being provided in the case of each motor with a system of two-position servo-controlled valves which establish a connection in the first position between an active chamber of the corresponding motor and a source of fluid under pressure in order to bring said motor to the work position and which are intended in the second position to initiate the return of said motor to its rest position, said valve systems being servo-controlled at least in order to change over from the second to the first position by means of a single work control device having at least temporary action, wherein said installation comprises at least one differential pressure detector which connects said motors together in pairs, and wherein said installation comprises a rest control device which is operated in dependence on said detector and comes into action in response to a pressure difference, said rest control device aforesaid being connected to all said valve systems in order to return all the valves to the second position when said at least one detector measures a pressure difference.

2. A control installation according to claim 1 for the hydraulic control of at least two jacks so arranged that each jack actuates a circuit breaker module and is continuously urged to the rest position corresponding to the open position of said circuit breaker by continuously available elastic tripping means, in which the second position of each valve system aforesaid establishes a communication between the jack chamber and a drain chamber, and in which each valve system comprises a self-maintaining hydraulic circuit for holding said system in the first position by hydraulic servo-control after discontinuation of the temporary action of the work control device, wherein the rest control device comprises a drain valve adapted to drain the self-maintaining hydraulic circuits of all the valve systems.

3. An installation according to claim 2, wherein a plurality of differential pressure detectors are provided, each differential pressure detector comprises a leak-tight enclosure divided into two chambers by a movable wall, each chamber aforesaid being respectively in communication with the active chamber of each of the two jacks and provided with at least one switching element operatively connected to said movable wall.

4. An installation according to claim 3, wherein the switching element is a normally closed hydraulic drain valve connected by means of an ancillary hydraulic circuit to the self-maintaining hydraulic circuits of all the valve systems, the closure member of said drain valve being returned to the open position by the movable wall when said wall is subjected to a differential pressure.

5. An installation according to claim 3, wherein the switching element is an electrical switch for controlling the excitation of a drain electrovalve which is connected to the self-maintaining hydraulic circuits.

6. An installation according to claim 3, wherein delay means are provided on each detector, said means being intended to permit actuation of the switching element by the movable wall only under the action of a pressure difference of predetermined value and duration.

7. An installation according to claim 6, wherein the delay means aforesaid comprise an operative connection having a dead range of travel between the movable wall and the switching element.

8. An installation according to claim 4, wherein the ancillary hydraulic circuit interposed between the drain valve aforesaid and the self-maintaining hydraulic circuit comprises a pressure-regulating drain-off unit in which the pressure-sensitive control element is in communication with said drain valve.

9. An installation according to claim 6, wherein the delay means aforesaid comprise a hydraulic connection with a calibrated constriction between the two aforesaid chambers of each differential pressure detector.

10. A method for carrying out the simultaneous operation of at least two fluid motors respectively between two positions consisting of a rest position and a work position, especially for controlling the operation of at least two hydraulic jacks so arranged that each jack actuates a circuit breaker module between an open or rest position and a closed or work position by sending a single order for changing the pressure within said motors, and for preventing any relative variation in the operation of said motors, said motors being continuously urged to return to their rest positions under the action of continuously available elastic means to which can be opposed a fluid pressure applied to said motors in order to bring them to the work position, wherein said method consists in comparing the pressures within said motors, in detecting any pressure difference, in producing in response to said pressure difference a priority order for return to the rest position by draining said motors, and in applying said order to all the motors so that any non-simultaneous operation initiates the return of all the motors to the rest position under the action of said elastic means.

11. A method according to claim 10 for carrying out by means of a single transient pressurization order the simultaneous operation of at least two fluid jacks each controlled by a two-position supply and drain valve, said valves being each provided with a self-maintaining fluid circuit for holding said valve in the supply position in opposition to restoring means after disappearance of said transient order, wherein the aforesaid draining order which is produced in response to the detection of a pressure difference within the motors is applied to said fluid circuits for self-maintaining the two valves so that said two valves are restored to the drain-off position.

12. A method for carrying out the simultaneous operation of at least two fluid motors so arranged that each motor actuates a circuit breaker module either to open or to closed position in response to an order for changing the fluid pressure within all the motors, each motor being urged to the open position under the action of elastic means to which can be opposed a fluid pressure applied to said motors for bringing them to closed position, said method consisting in (a) comparing the fluid pressures entering said motors; (b) detecting any difference in pressure between said motors; (c) establishing in response to a detected pressure difference a priority order for return to the open position by discharging said motors; and (d) applying said priority order to all the motors so that a non-simultaneous operation initiates the return of all the motors to the open position under the action of said elastic means.

13. A control system for the simultaneous operation of at least two fluid motors so arranged that each fluid motor actuates a circuit breaker module either to closed or to open position, said system comprising, for each fluid motor, a two-position valve which establishes, when in the first position, a communication between an active chamber of the corresponding motor and a fluid pressure source whereby to bring the motor into closed position, and which initiates, when in the second position, the return of the motor to the open position; and control means responsive respectively to a circuit closing signal for causing all the valves to be shifted to said first position thereof; wherein said control system further comprises at least one differential pressure detector which connects said fluid motors together in pairs, and at least one control device operable in response to a detected pressure difference and connected to all said valves for causing them to be shifted to said second position thereof when a pressure difference is detected by said detector upon emission of a circuit closing signal.

* * * * *